US006074234A

United States Patent [19]

Hasegawa

[11] Patent Number: 6,074,234

[45] Date of Patent: Jun. 13, 2000

[54] CONNECTOR ASSEMBLY WITH LOCKING STRUCTURES DISPOSED IN CONCAVE EXTERIOR CORNERS

[75] Inventor: Teruaki Hasegawa, Yokkaichi, Japan

[73] Assignee: Sumitomo Wiring Systems, Ltd., Japan

[21] Appl. No.: 09/287,504

[22] Filed: Apr. 7, 1999

[30] Foreign Application Priority Data

Apr. 13, 1998 [JP] Japan ..... 10-101594

[51] Int. Cl.[7] ..... H01R 13/627

[52] U.S. Cl. ..... 439/357; 439/353

[58] Field of Search ..... 439/357, 358, 439/354, 353

[56] References Cited

U.S. PATENT DOCUMENTS

| | | | |
|---|---|---|---|
| 3,407,717 | 10/1968 | Ernisse | 439/357 |
| 4,975,075 | 12/1990 | Jinno et al. | 439/357 |
| 4,979,910 | 12/1990 | Revil et al. | 439/357 |
| 5,320,555 | 6/1994 | Okabe | 439/354 |
| 5,342,215 | 8/1994 | Silbernagel et al. | 439/357 |
| 5,378,168 | 1/1995 | Sumida | 439/358 |
| 5,558,535 | 9/1996 | Saka et al. | 439/357 |
| 5,613,871 | 3/1997 | Akeda . | |
| 5,628,649 | 5/1997 | Yagi et al. | 439/354 |

*Primary Examiner*—Lincoln Donovan
*Assistant Examiner*—Hae Moon Hyeon
*Attorney, Agent, or Firm*—Anthony J. Casella; Gerald E. Hespos; Michael J. Porco

[57] ABSTRACT

A connector is configured to define a small cross-section when viewed in a direction of connection. The connector includes a housing [10] and an electric part [20]. A lock arm [16] is provided for locking the housing [10] and the electric part [20] in their connected state. The lock arm 16 is arranged in a rectangular dead space [SL] enclosed by upper and left terminal accommodating portions [11A, 11C] and an upper left corner portion of a rectangular receptacle [31]. Accordingly, the shape of a connector when viewed in a direction of connection can be made smaller as compared with a case where the lock arm [16] is provided on the outer surface of the terminal accommodating portions [11A, 11B, 11C, 11D].

17 Claims, 5 Drawing Sheets

CONNECTOR ASSEMBLY WITH LOCKING STRUCTURES DISPOSED IN CONCAVE EXTERIOR CORNERS

BACKGROUND OF THE INVENTION

1. Field of the Invention

The present invention relates to a connector.

2. Description of the Related Art

A known connector is provided for fitting an electric part into a housing. The electric part may be provided, for example, with a circuit for a relay; while the housing may be provided with terminal fittings. Thus, the prior art connector enables the circuit for the relay to be connected to the terminal fittings. A prior art connector of this type is shown in FIG. 7. With reference to FIG. 7 a housing 1 is cross-shaped since terminal accommodating portions 2A, 2B, 2C, 2D for accommodating terminal fittings (not shown) project in four directions: upward, downward, leftward and rightward. An electric part 3 is engaged with a cross-shaped engagement end surface 1A of the housing 1. The cross-like shape of the housing 1 is specified by the ISO standards.

The housing 1 and the electric part 3 are locked into each other by the engagement of a lock arm 4 formed on the upper surface of the upper terminal accommodating portion 2A and a receiving projection 3A of the electric part 3. Further, the housing 1 is mounted in a rectangular container 5 by a mount portion 1B formed on the lower surface of the lower terminal accommodating portion 2B, such that the housing 1 is surrounded by the walls of the container 5.

The above prior art connector is large when viewed in the direction of connection since the lock arm 4 is provided on the top of the terminal accommodating portion 2A.

In view of the above, an object of the present invention is to make the shape of the connector when viewed in the direction of connection smaller.

SUMMARY OF THE INVENTION

According to the invention, there is provided a connector, comprising a housing with three or more terminal accommodating portions adapted to accommodate terminal fittings. The terminal accommodating portions project in three or more directions and are angularly distributed (as seen in cylindrical coordinates, wherein the axis extends along the longitudinal direction of the housing). The connector further includes an electric part to be connected with an engagement end surface of the housing. A locking means is provided for locking the housing and the electric part in their connected state. The locking means is provided in a space angularly arranged between two neighboring terminal accommodating portions projecting in directions at an angle different from 0° and 180°.

According to a preferred embodiment, the connector further comprises a mount member having a receptacle into which the housings are at least partially insertable. The space in which the locking means is disposed is defined by two neighboring terminal accommodating portions preferably projecting in directions at an angle different from 0° and 180° and a lateral or corner portion of the receptacle.

Preferably, the housing has a substantially cross-like shape and comprises four terminal accommodating portions projecting in four directions. The locking means is provided in a substantially rectangular space defined by two of the terminal accommodating portions project in mutually substantially orthogonal directions and a corner portion of the receptacle is substantially rectangular.

According to a further preferred embodiment, there is provided a connector, comprising a housing having four terminal accommodating portions adapted to accommodate terminal fittings. The terminal accommodating portions are arranged in a cross-shape and thus projecting in four directions. The housing is accommodated in a substantially rectangular receptacle. The connector further includes an electric part to be connected with a substantially cross-like engagement end surface of the housing, and a locking means is provided for locking the housing and the electric part in their connected state. The locking means is provided in a substantially rectangular space defined by two of the terminal accommodating portions projecting in mutually orthogonal directions and a corner portion of the rectangular receptacle.

Since the space where the locking means is provided is a dead space, the shape of the connector when viewed in a direction of connection can be made smaller, which results in a reduced dimension of the rectangular receptacle.

Preferably, the locking means comprises an elastically deformable lock arm having a fixed end and a free end, and an engaging portion to be engaged with the lock arm. The free end of the lock arm is arranged in such a position as to be exposed from the rectangular receptacle in the connected state of the housing and the electric part.

The lock arm and the engaging portion preferably are unlocked or unlockable by bringing a jig into engagement with the lock arm. To unlock the locking means, the jig is brought into engagement of the free end of the lock arm to deform the lock arm in the unlocking direction. Since the free end of the lock arm is exposed from the rectangular receptacle, the jig can be brought into engagement with the lock arm in a direction intersecting with an axis of the rectangular receptacle.

Further preferably, the free end of the lock arm is formed with a slanted guide surface inclined with respect to a direction in which a jig is brought or bringable into engagement. Because of the slanted guide surface, the jig can be brought into engagement with the lock arm without getting caught.

Still further preferably, there is provided an excessive deformation restricting means for restricting a deformation of the lock arm in an unlocking direction beyond a specified limit. The excessive deformation restricting means for restricting the degree of deformation of the lock arm in the unlocking direction prevents the lock arm from being excessively deformed beyond its elasticity limit.

Most preferably, the excessive deformation restricting means is provided at or on the electric part. Since the excessive deformation restricting means is provided at or on the electric part, it is not necessary to make the housing larger.

According to a further preferred embodiment, the housing is locked in the mount member by mount lock means that may be arranged outside the space between the two neighboring terminal accommodation portions.

Preferably, two or more housings can be inserted at least partially into respective receptacles of the mount member substantially side by side.

Most preferably, the three or more terminal accommodation portions are substantially equally spaced in the angular direction.

These and other objects, features and advantages of the present invention will become more apparent upon a reading of the following detailed description and accompanying drawings.

DETAILED DESCRIPTION OF THE PREFERRED EMBODIMENTS

Figure 1:
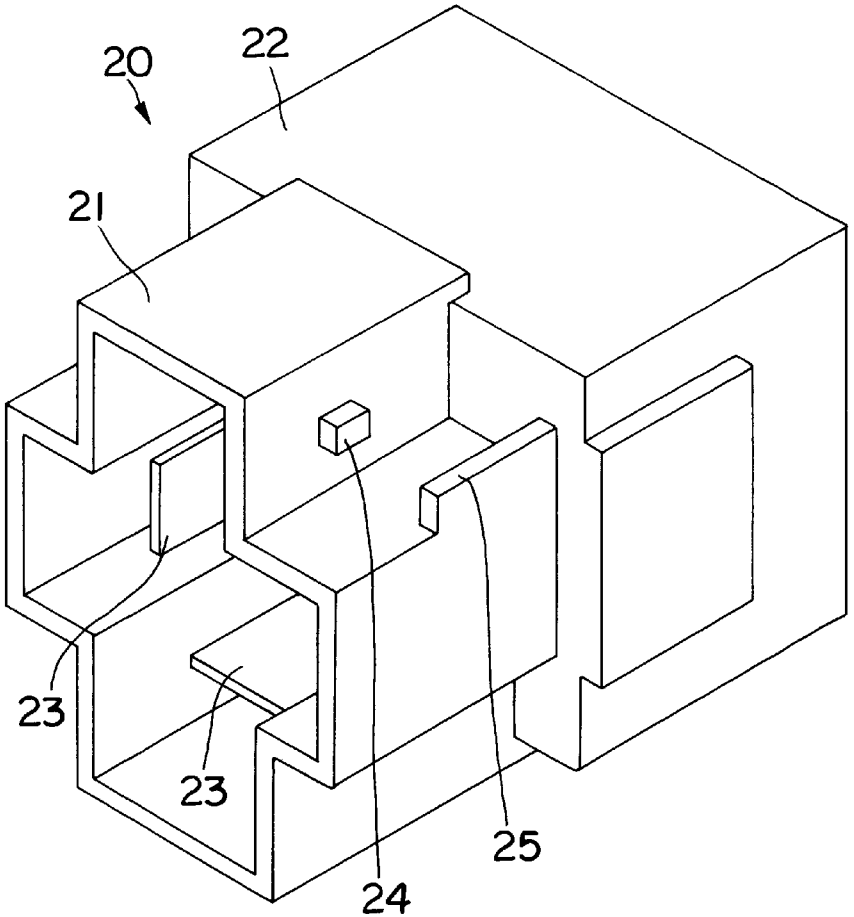
FIG. 1 is a perspective view of a housing and an electric part according to a first embodiment.
Figure 1:
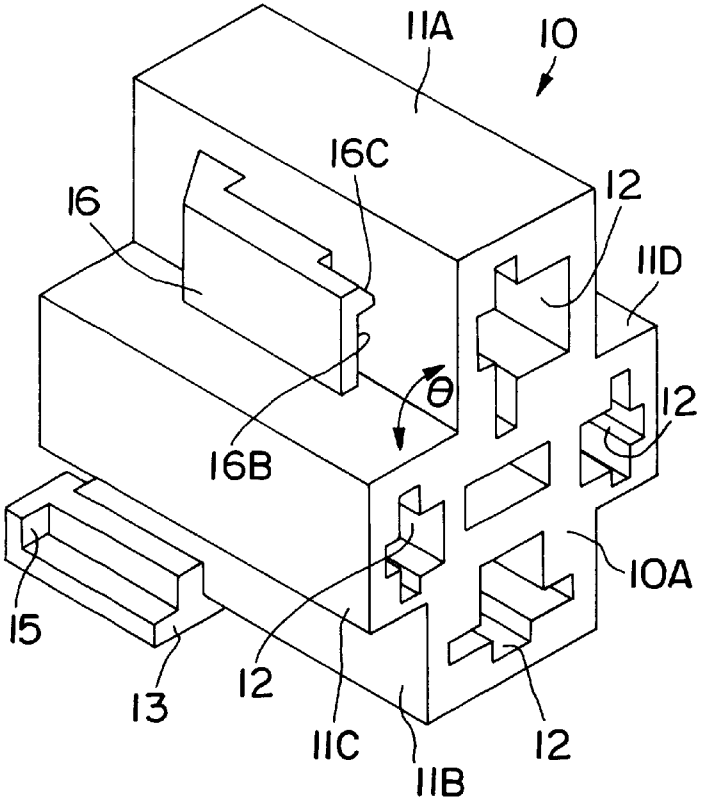
Figure 4:
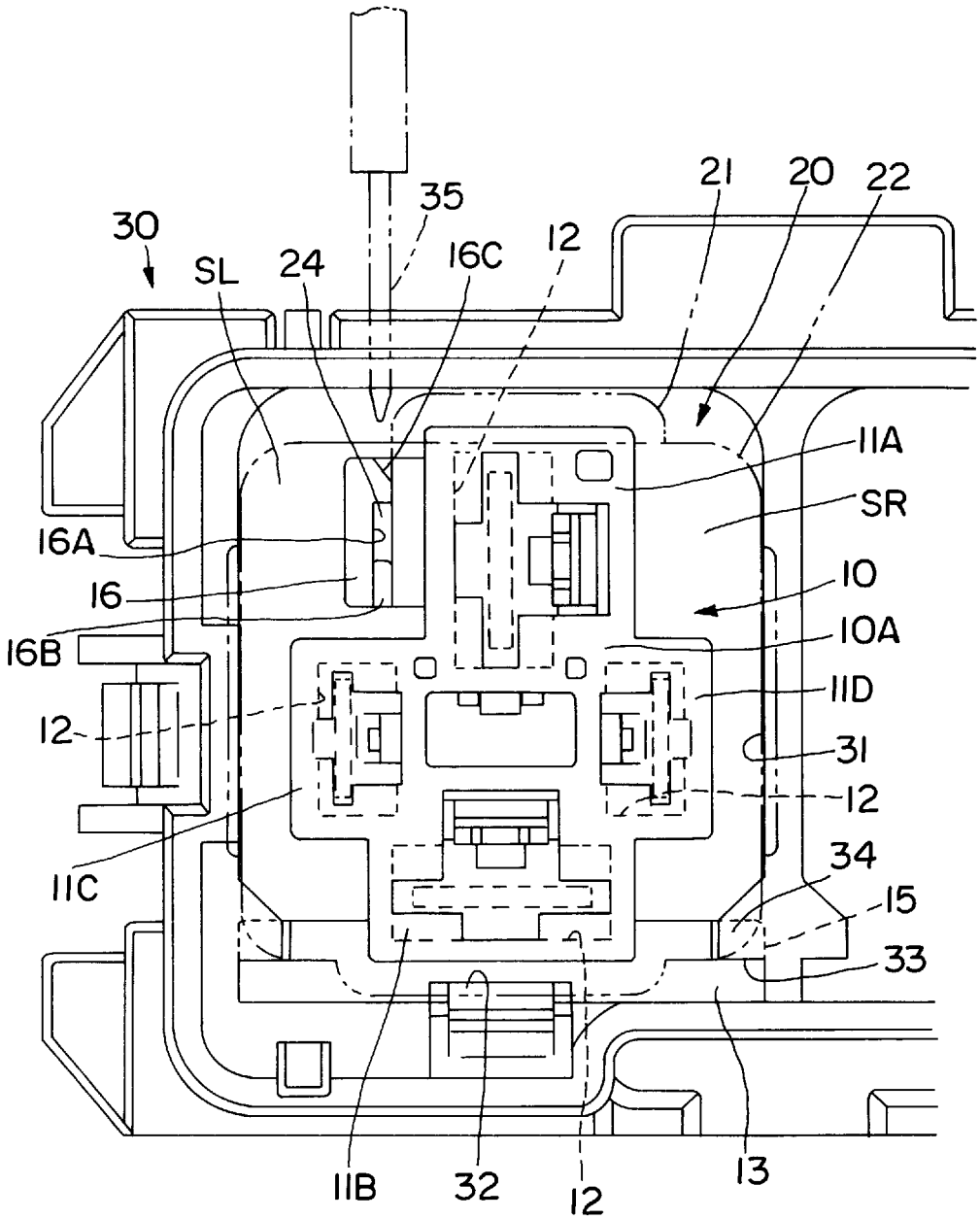
FIG. 4 is a front view showing the state where the housing is accommodated in the rectangular receptacle in the first embodiment.

A first embodiment of the invention, as described with reference to FIGS. 1 to 6, includes a housing 10. The housing 10 has e.g. four terminal accommodating portions 11A, 11B, 11C, 11D projecting in pairs in substantially opposed directions, e.g. upward, downward, leftward and rightward. Thus, the housing 10 is substantially cross-shaped when viewed in a direction toward its front surface 10A. The front end surface 10A is the engagement end surface, which is shown in FIGS. 1 and 4 and which is the right end surface in FIGS. 2 and 3. Cavities 12 are formed in the respective terminal accommodating portions 11A, 11B, 11C, 11D. Mating connectors (not shown) are fitted or fittable into the respective cavities 12 preferably from behind, and male terminal fittings 23 of the electric part 20 are at least partially inserted or insertable into the cavities 12 preferably from the front surface side. As a result, the male terminal fittings 23 and mating terminal fittings (not shown) are or can be connected in the cavities 12.

The electric part 20 preferably has a substantially cross-shaped or star-shaped receptacle to be fitted substantially on a portion, preferably a front half of the housing 10. A substantially rectangular coil container 22 (electric or electronic part container) is continuously (integrally or unitarily) formed at the rear end of the receptacle 21 which is the right end in FIGS. 5 and 6. In the coil container 22, a relay coil or other such electric or electronic part (not shown) is accommodated, and base ends of four male terminal fittings 23 are fixed. The respective male terminal fittings 23 at least partially project into the receptacle 21 and are at least partially inserted or insertable into the cavities 12 with the electric part 20 and the housing 10 connected with each other.

The arrangement of the male terminal fittings 23 and the cross-shaped housing 10 and receptacle 21 are preferably specified by the ISO standards.

The housing 10 is mountable on a mount member 30 comprised of a plurality of substantially rectangular receptacles or hoods or containers 31 arranged substantially side by side. The rectangular receptacles 31 are hollow entirely along forward and backward directions. A mount portion 13 is provided as a mount means, and bulges sideways on the lower surface of the terminal accommodating portion 11B at a lateral side, e.g. at the bottom of the housing 10. A step-shaped locking portion 14 is formed on the lateral, preferably lower surface of the mount portion 13 (FIG. 2), and an elastically deformable lock arm 32 is formed on the corresponding, preferably the lower surface of each rectangular receptacle 31. When the housing 10 is pushed into the rectangular receptacle 31, preferably from behind, the opposite ends of the mount portion 13 are guided by guide grooves 33 formed in the rectangular receptacle 31. When the housing 10 reaches a predetermined mount position, stoppers 15 thereof come into contact with receiving portions 34 of the rectangular receptacle 31, substantially preventing any further movement of the housing 10 forward or in an insertion direction. Further, a backward movement of the housing 10 is restricted by the engagement of the lock arm 32 and the locking portion 14. As a result, the housing 10 is fixed in the rectangular receptacle 31. In this mount state, the front end of the housing 10 is substantially exposed in a forward or mating direction with the electric part 20 from the rectangular receptacle 31 (see FIG. 2). With the electric part 20 connected with the housing 10, the leading end of the receptacle 21 is at least partially accommodated in the rectangular receptacle 31.

The housing 10 fixed or positioned in the substantially rectangular receptacle 31, described as above, has its upper, lower, left and right sides substantially enclosed by the inner surfaces of the rectangular receptacle 31 when viewed from the front surface side (see FIG. 4). Only narrow clearances exist between the upper surface of the upper terminal accommodating portion 11A and the upper surface of the rectangular receptacle 31, and between the right side surface of the right terminal accommodating portion 11D and the right side surface of the rectangular receptacle 31, between the left side surface of the left terminal accommodating portion 11C and the left side surface of the rectangular receptacle 31. However, relatively large spaces or clearances or interstices exist in an area SR, which is the area at an upper right side of the housing 10 enclosed by the upper and right terminal accommodating portions 11A, 11D and an upper right corner portion of the rectangular receptacle 31. Similarly an area or space or clearance or interstice SL is defined in an area at an upper left side of the housing 10 enclosed by the upper and left terminal accommodating portions 11A, 11C and an upper left corner portion of the rectangular receptacle 31. Small rectangular spaces or clearances or interstices are also left at lower right and lower left sides of the housing 10.

In this embodiment, a locking means for locking the housing 10 and the electric part 20 in their connected state is provided in the space SL. The locking means is comprised of a lock arm 16 that preferably projects forward from a rear end position of the left side surface of the upper terminal accommodating portion 11A, and an engaging portion 24 that projects in a position of the receptacle 21 corresponding to the lock arm 16. A step-shaped locking portion 16A is formed at a free end (leading end) of the inner surface of the lock arm 16 facing the terminal accommodating portion 11A. This locking portion 16A is brought or bringable into engagement with the engaging portion 24 to lock the housing 10 and the electric part 20 in their connected state.

A slanted engaging surface 16B is formed at the free end of the lock arm 16. During the connection of the housing 10 and the electric part 20, this slanted engaging surface 16B comes into contact with the engaging portion 24, and thus the lock arm 16 moves over the engaging portion 24 while smoothly undergoing an elastic deformation outwardly (leftward).

Figure 2:
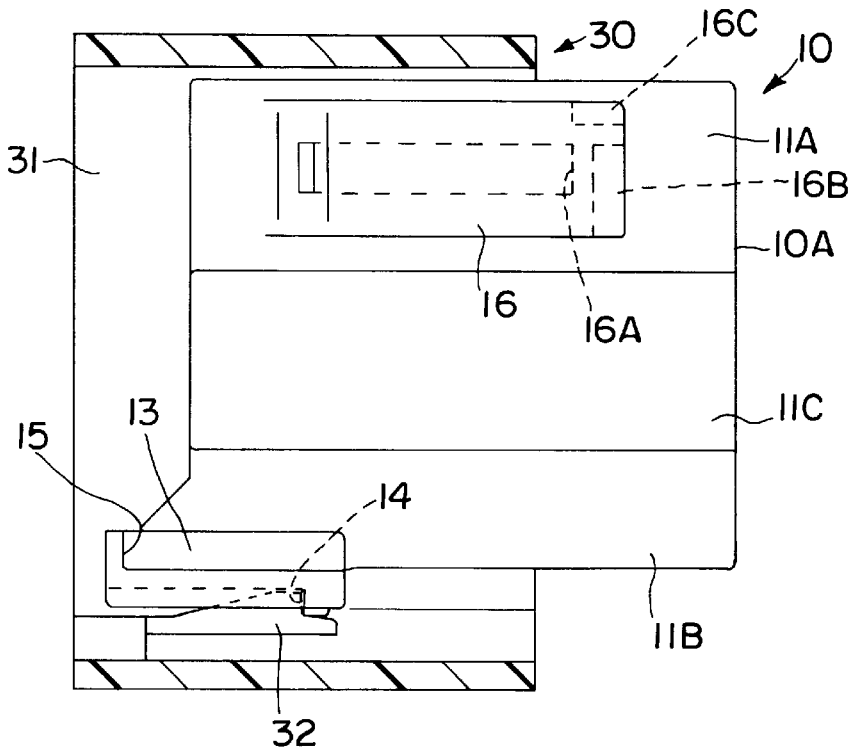
FIG. 2 is a vertical section showing a state where the housing is accommodated in a rectangular receptacle in the first embodiment.
Figure 3:
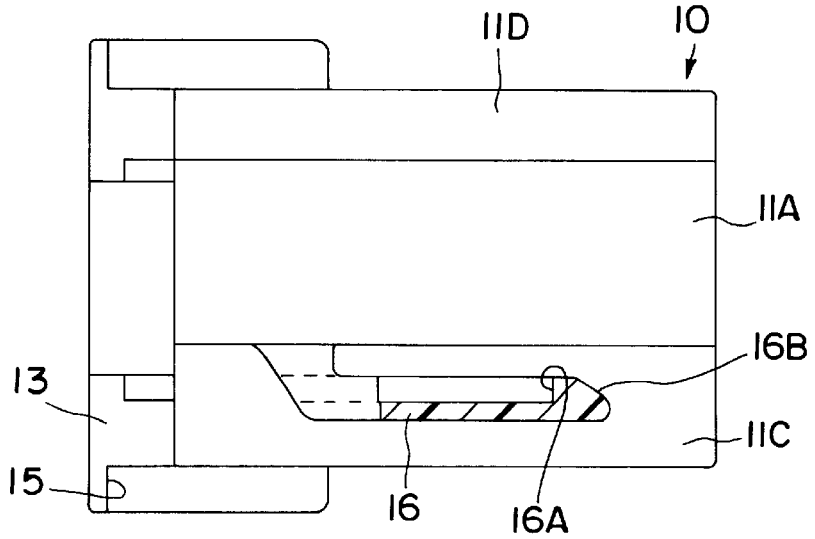
FIG. 3 is a plan view partly in section of the housing of the first embodiment.
Figure 5:
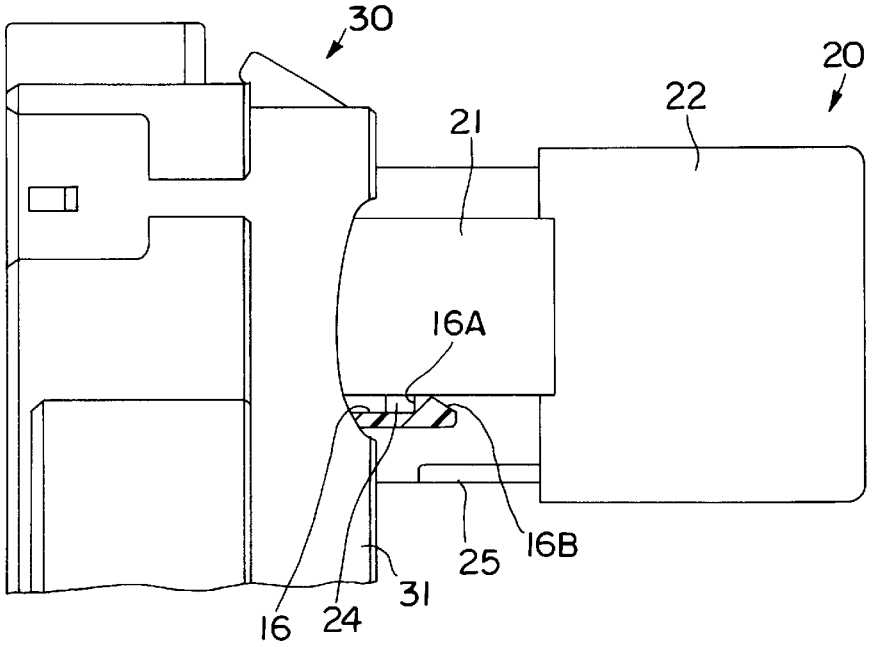
FIG. 5 is a plan view partly in section showing a state where the housing and the electric part are lockingly connected in the first embodiment.
Figure 6:
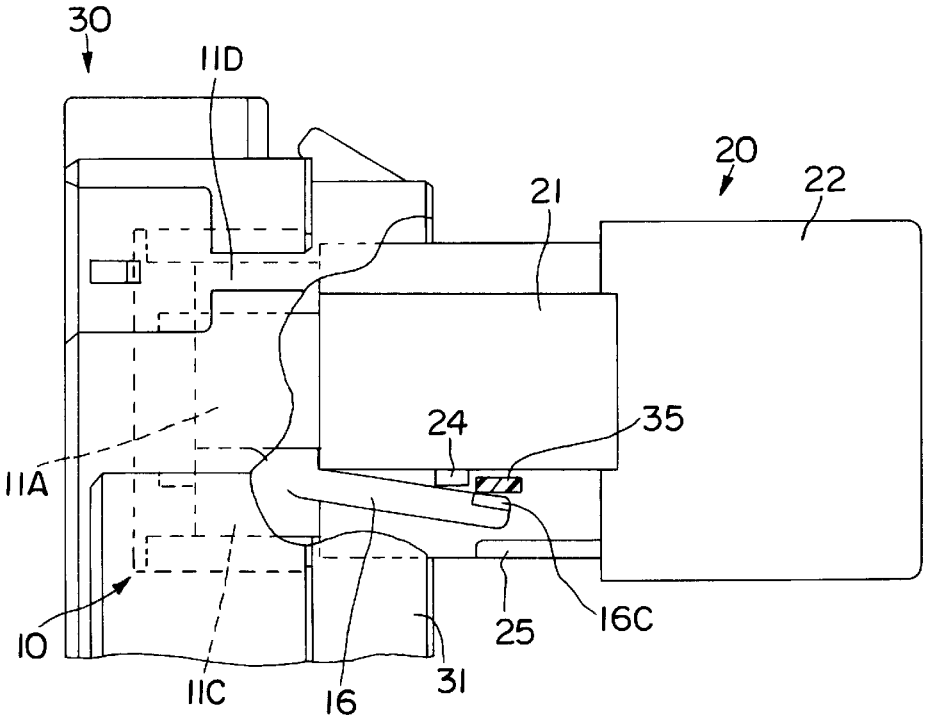
FIG. 6 is a plan view partly in section showing a state where the housing and the electric part are unlocked in the first embodiment.
Figure 7:
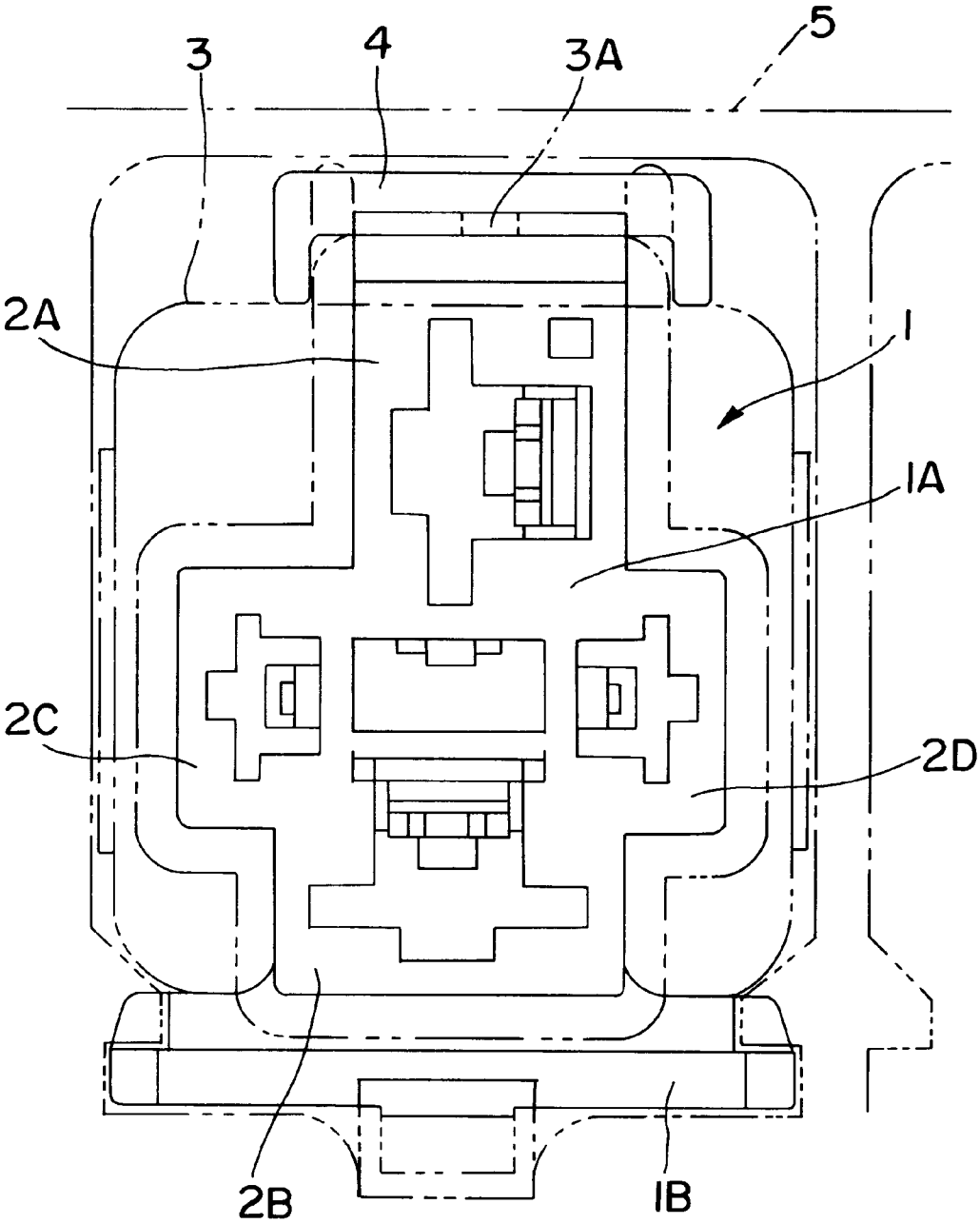
FIG. 7 PRIOR ART
FIG. 7 is a front view of a prior art connector.

With the housing 10 fixed in the rectangular receptacle 31 and the electric part 20 connected with the housing 10, the free end of the lock arm 16 is located to project substantially forward of the rectangular receptacle 31 (see FIGS. 2, 5 and 6). Accordingly, the lock arm 16 is not seen by being concealed by the coil container 22 of the electric part 20 when viewed from the front surface side (right side of FIGS. 5 and 6). However, the lock arm 16 can be seen from above in FIG. 4 because nothing is located thereabove, and a jig 35 can be inserted toward the lock arm 16. In other words, to unlock the housing 10 and the electric part 20, the jig 35 may be inserted into a clearance between the lock arm 16 and the receptacle 21 not from the front surface side, but from above, thereby elastically deforming the lock arm 16 outwardly so as to disengage the lock arm 16 from the engaging portion 24.

A slanted guide surface 16C is inclined with respect to the insertion direction of the jig 35 and is formed at the inner upper edge of the free end of the lock arm 16. Because of this slanted guide surface 16C, the leading end of the jig 35 can be inserted easily without being struck against the upper surface of the lock arm 16.

On an outer surface of the receptacle 21, a rib-shaped excessive deformation restricting or preventing portion 25 (excessive deformation restricting means) is formed such that it is located outside the free end of the lock arm 16 in the connected state with the housing 10. This restricting portion 25 permits an elastic deformation necessary to disengage the lock arm 16 from the engaging portion 24. However, before being excessively deformed e.g. beyond its elasticity limit, the free end of the lock arm 16 comes into contact with the restricting portion 25 to prevent any further deformation.

To assemble the connector, the housing 10 is fixed to the rectangular receptacle 31 by being fitted thereinto preferably from behind. The electric part 20 then is fitted into the housing 10, preferably from behind. During this connection, the lock arm 16 moves over the engaging portion 24 while undergoing an elastic deformation, and is engaged with the engaging portion 24 upon attaining a proper connected state. In this way, the housing 10 and the electric part 20 are locked in their connected state.

To separate the electric part 20 from the housing 10 in this connected state, the jig 35 is inserted from above in FIG. 4 into the clearance between the free end of the lock arm 16, which is exposed between the rectangular receptacle 31 and the electric part 20, and the left outer surface of the receptacle 21. Movement of the jig 35 then elastically deforms the lock arm 16 outwardly to separate the lock arm 16 from the engaging portion 24. Thus, unlocking is effected and the electric part 20 can be separated from the housing 10 as it is.

There is only a slight clearance between the lock arm 16 and the receptacle 21. Since the lock arm 16 is formed with the slanted guide surface 16C, unlocking can be performed securely if the leading end of the jig 35 is inserted here.

As described above, in this embodiment, the lock arm 16 for locking the housing 10 and the electric part 20 in their connected state is provided in the rectangular dead space SL enclosed by the upper and left terminal accommodating portions 11A, 11C and the upper left corner of the rectangular receptacle 31. Accordingly, as compared with the case where the lock arm 16 is provided on the outer surface of any of the terminal accommodating portions 11A, 11B, 11C, the shape of the connector when viewed from the direction of connection is smaller.

In this embodiment, the jig 35 is inaccessible to the lock arm 16 along the longitudinal axis (forward and backward directions) of the rectangular receptacle 31 because of the coil container 22 standing in the way. Since the free end of the lock arm 16 projects forwardly from the rectangular receptacle 31 and is exposed when viewed e.g. from above in FIG. 4, unlocking of the lock arm 16 can be effected by inserting the jig 35 from above (in a direction intersecting or arranged at an angle different from 0° or 180° with the longitudinal axis of the rectangular receptacle 31).

Further, since the lock arm 16 is formed with the slanted guide surface 16C inclined with respect to the insertion direction of the jig 35, the jig 35 can be easily brought into engagement with the lock arm 16 without getting caught.

Furthermore, since the excessive deformation restricting portion 25 is provided to restrict an excessive deformation of the lock arm 16 in the unlocking direction, there is no likelihood that the lock arm 16 is plastically deformed by being deformed beyond its elasticity limit.

The present invention is not limited to the described and illustrated embodiment, but the following embodiments also are embraced by the technical scope of the present invention as defined in the claims. Besides the following embodiments, a variety of other changes can be made without departing from the scope and spirit of the invention as defined in the claims.

Although the lock means provided on the electric part is a projection in the foregoing embodiment, it may be a hole according to the invention.

Although the lock means provided on the housing is an elastically deformable lock arm in the foregoing embodiment, the one on the electric part may be a lock arm according to the invention. In such a case, the lock means on the housing may be a projection or a hole.

Although the electric part has at least partially such a rectangular shape as to cover not only the cross-shaped engagement end surface of the housing, but also the accommodating space for the lock arm in the foregoing embodiment, the invention is applicable to a case where the electric part is substantially completely cross-shaped similar to the housing. In such a case, the free end of the lock arm is arranged inside the rectangular receptacle, and the jig can be brought into engagement with the lock arm by being inserted substantially along the longitudinal axis of the rectangular receptacle (connection direction of the housing and the electric part) when unlocking is effected.

Although the excessive deformation restricting means is formed on the electric part in the foregoing embodiment, it may be formed on the housing or on the mount member.

Although the description has been made with reference to a housing 10 having four terminal accommodation portions 11A–11D, the invention is also applicable to a housing having three or five or more terminal accommodation portions that are spaced angularly (or spaced in an angular direction) as seen in cylindrical coordinates, wherein the axis substantially corresponds to the longitudinal axis of the housing. The electric part then is shaped accordingly. Preferably, the housing comprises an even number of terminal accommodation portions that are spaced equally in the angular direction. Thus all the angles θ between two neighboring terminal accommodation portions are preferably substantially equal.

What is claimed is:

1. A connector, comprising:

a housing with an engagement end surface and at least first, second and third terminal accommodating portions, each said terminal accommodating portion being adapted to accommodate a terminal fitting extending in a mating direction from said engagement end surface, said terminal accommodating portions being angularly distributed to project in at least three directions from a central portion of said housing, said terminal accommodating portions each having an outer surface and a pair of side surfaces extending inwardly toward the central portion of the housing from the respective outer surface, each said side surface defining a convex corner with said outer surface of the respective terminal accommodating portion, one said side surface of said first terminal accommodating portion intersecting one said side surface of said second terminal accommodating portion to define a concave corner extending rearwardly from said engagement end surface, the other side surface of the first terminal accommodating portion intersecting one said side surface of said third terminal accommodating portion to define a second concave corner extending rearwardly from said engagement end surface, an electric part connectable with the engagement end surface of the housing along said mating direction, and a locking means for locking the housing and the electric part in their connected state, wherein the locking means is provided in the concave corner between the first and second terminal accommodating portions.

2. A connector according to claim 1, further comprising a mount member having a receptacle into which the housing is at least partially insertable.

3. A connector according to claim 2, wherein the housing further comprises a fourth terminal accommodating portion projecting in a fourth direction from the central portion of the housing, said first, second, third and fourth terminal accommodating portions being distributed angularly such that the housing has a substantially cross-like shape, the side surfaces of the terminal accommodating portions that define the concave corner projecting in mutually substantially orthogonal directions such that the concave corner is a substantially rectangular concave corner portion of the receptacle.

4. A connector according to claim 2, wherein the locking means comprises an elastically deformable lock arm having a fixed end and a free end, and an engaging portion engageable with the lock arm, and wherein the free end of the lock arm is arranged in such a position as to be exposed from the receptacle in the connected state of the housing and the electric part.

5. A connector according to claim 4, wherein the lock arm (16) and the engaging portion are formed to define a jig insertion region to accommodate a jig inserted in a direction extending substantially orthogonal to the mating direction such that movement of the jig into engagement with the lock arm deflects the lock arm away from the engaging portion to unlock the housing from the electric part.

6. A connector according to claim 5, wherein the free end of the lock arm is formed with a slanted guide surface inclined with respect to the direction in which the jig is brought into engagement.

7. A connector according to claim 5, further comprising an excessive deformation restricting means for restricting a deformation of the lock arm in an unlocking direction beyond a specified limit.

8. A connector according to claim 7, wherein the excessive deformation restricting means is provided on the electric part.

9. A connector according to claim 2, wherein the housing is locked in the mount member by mount lock means arranged outside of the concave corner between the first and second terminal accommodation portions.

10. A connector according to claim 2, wherein at least two housings are at least partially insertable into respective receptacles of the mount member substantially side by side.

11. A connector according to claim 4, wherein the fixed end of the elastically deformable lock arm is provided on one of said side surfaces defining the concave corner and at a location spaced from the engagement end surface of said housing, the free end of the elastically deformable lock arm being between the fixed end thereof and the engagement end surface of the housing.

12. A connector according to claim 11, wherein the electric part includes a mating end, a plurality of walls extending away from the mating end of the electric part and defining a receptacle dimensioned and configured for receiving portions of the housing adjacent the engagement end surface thereof, one said wall of said electric part being slidably receivable between the elastically deformable lock arm and the side surface from which the fixed end of the lock arm extends.

13. A connector according to claim 12, wherein the free end of the elastically deformable lock arm is configured to define a jig insertion space between the elastically deformable lock arm and the electric part, the jig insertion space being accessible along a direction extending substantially perpendicularly to the mating direction.

14. A connector, comprising:

a housing with an engagement end surface and a rear surface, portions of said housing extending rearwardly from said engagement end surface being substantially cross-shaped with first, second, third and fourth terminal accommodating portions angularly distributed relative to one another and projecting in four directions, each said terminal accommodating portion having an outer surface and a pair of side surfaces intersecting the respective outer surface at a convex angle and extending inwardly from the respective outer surface, each said side surface of each terminal accommodating portion intersecting one of said side surfaces of another of said terminal accommodating portions for defining concave corners, such that first, second, third and fourth concave corners are defined on said housing and extend rearwardly from the engagement end surface of said housing;

an electric part having a mating end with a receptacle formed therein, the receptacle being configured for receiving the engagement end surface of the housing therein;

first and second locking structures provided respectively on the housing and on the electric part for releasably locking the housing and the electric part in their engaged condition, the first locking structure being provided in one of said concave corners defined on the housing.

15. A connector according to claim 14, wherein the first locking structure comprises a resiliently deflectable locking arm having a fixed end rigidly joined to one of said side surfaces that defines said first concave corner and a free end projecting from the fixed end toward the engagement end surface of the housing.

16. A connector according to claim 15, wherein the resiliently deflectable lock arm is formed with a jig insertion space accessible by a jig inserted in a direction substantially parallel to the engagement end surface of said housing.

17. A connector assembly comprising:

a housing with an engagement end surface and at least three terminal accommodating portions, each said terminal accommodating portion being configured to accommodate a terminal fitting extending in a mating direction aligned substantially orthogonal to said engagement end surface of said housing, said terminal accommodating portions being angularly distributed to project in at least three directions and to define a plurality of concave corners extending rearwardly from said engagement end surface;

an electric part connectable with the engagement end surface of the housing along said mating direction; and a resiliently deflectable lock arm formed on a portion of said housing defining one of said concave corners, said lock arm having a fixed end and a free end, said free end being configured for engaging said electric part when said housing and said electric part are connected, a portion of said lock arm in proximity to said free end being formed to define a jig insertion space, said jig insertion space being configured for receiving a jig inserted substantially perpendicular to the mating direction for enabling disconnection of said housing from said electric part.

* * * * *